US006604251B2

(12) United States Patent
Minami

(10) Patent No.: US 6,604,251 B2
(45) Date of Patent: Aug. 12, 2003

(54) HAIR WASHING STAND

(75) Inventor: Nobuyuki Minami, Osaka (JP)

(73) Assignee: Oohiro Works, Ltd. (JP)

( * ) Notice: Subject to any disclaimer, the term of this patent is extended or adjusted under 35 U.S.C. 154(b) by 0 days.

(21) Appl. No.: 09/846,000

(22) Filed: Apr. 30, 2001

(65) Prior Publication Data

US 2001/0037523 A1 Nov. 8, 2001

(30) Foreign Application Priority Data

May 8, 2000 (JP) ..... 2000-134964

(51) Int. Cl.[7] ..... A45D 19/00
(52) U.S. Cl. ..... 4/515
(58) Field of Search ..... 4/515–522

(56) References Cited

U.S. PATENT DOCUMENTS 4,660,233 A * 4/1987 Beaver ..... 4/516
4,821,347 A 4/1989 Nash
5,906,012 A * 5/1999 Sakane et al. ..... 4/515
6,243,885 B1 * 6/2001 Lopez-Torres, Jr. ..... 220/737

FOREIGN PATENT DOCUMENTS

DE 77 10 181 7/1977
JP 11-276235 10/1999

* cited by examiner

*Primary Examiner*—Charles E. Phillips
(74) *Attorney, Agent, or Firm*—Wall Marjama & Bilinski LLP

(57) ABSTRACT

A movable hair washing stand, upon which hair washing materials are kept. The hair washing materials are placed on a movable arm part or a rotation shaft part of the stand. A tray, in which the hair washing agents and hair washing tools can be placed, is provided on the movable arm part. Further, the tray is detachably placed, thereby facilitating preparation and carrying of the hair washing agents and hair washing tools, and further provide for ease of cleaning of the hair washing stand.

4 Claims, 5 Drawing Sheets

HAIR WASHING STAND

FIELD OF THE INVENTION

The present invention relates to a hair washing stand, on a movable arm of which hair washing materials such as a shampoo agent, a treatment agent, hair washing tools, and the like are placed which are used for shampooing.

BACKGROUND OF THE INVENTION

Conventionally, in a barber shop or a beauty salon, hair washing agents such as a shampoo agent and a treatment agent, and hair washing tools are usually placed in a cabinet or the like which is located in a neighborhood of a mobile hair washing stand and is provided separately from the hair washing stand. An operator performing the shampooing takes out the desired hair washing agents and hair washing tools from the cabinet on every wash occasion. A hair washing stand, which is provided as a separate unit near the wash bowl, is used to hold the hair washing agents and the hair washing tools thereon. The operator must take out the required hair washing agents and hair washing tools from the cabinet and place them on the stand.

At performance of shampooing with employing a movable hair washing stand, if the hair washing agents such as the shampoo agent and the treatment agent, and the hair washing tools are kept in the cabinet which is provided separately from the hair washing stand, the part of the hair washing stand might be away from the cabinet. Therefore, when the hair washing agents and the hair washing tools are required at the performance of shampooing, the person for shampooing must go for the same to the cabinet, which results in interfering his works. Further, when a unit, on which the hair washing agents and the hair washing tools are placed, is provided at the part, the hair washing agents and the hair washing tools are placed at hand of the person for shampooing, which results in an impediment to his works.

SUMMARY OF THE INVENTION

To solve the above problems, it is an object of the present invention to provide a hair washing stand for improving performance.

Other objects and advantages of the present invention will become apparent from the detailed description and specific embodiments described below and are provided only for illustration since various additions and modifications within the spirit and scope of the invention will be apparent to those of skill in the art from the detailed description.

According to a first aspect of the present invention, a hair washing stand comprises: a pedestral part that is fixed on a floor surface, a bowl part, at which a hair washing of a person to be shampooed is performed, and a movable arm mechanism having plural arms, which can move in a circle in opposite directions, for supporting the bowl part, wherein a placing part, on which hair washing materials such as hair washing agents such as a shampoo agent and a treatment agent, and hair washing tools are placed, is provided on one arm of the movable arm mechanism. Therefore, the hair washing materials are placed at hand, whereby the hair washing efficiency can be better facilitated.

According to a second aspect of the present invention, the placing part of holding hair washing materials is a tray positioned on the one arm. Therefore, when the tray is fixed, the position of the hair washing materials cannot be varied. However, when the tray is not fixed, the tray can be placed within the reach of the operator.

According to a third aspect of the present invention, the tray is detachably mounted on the one arm. Therefore, the hair washing materials, which are varied as occasion demands, can be prepared together with the tray.

According to a fourth aspect of the present invention, the placing part of hair washing materials is a surface of the one arm, directly on which the hair washing materials are placed. Therefore, a position of the hair washing materials can be varied to a position where it is most suitable for the operator.

According to a fifth aspect of the present invention, the placing part of hair washing materials is a space on the surface of the one arm, the space being surrounded by a fence for preventing the materials from falling. Therefore, it is possible to prevent the materials from falling from the placing position.

As constructed above, there is no necessity for moving the hair washing materials from the wash site during the performance of a shampoo. The position of the hair washing materials is kept away from the wash bowl, whereby the hair washing materials do not impede works at hand, and further the hair washing materials can be placed at a position within easy reach of the operator. Further, the tray is detachable, whereby the hair washing materials can be easily prepared, and also can be easily reached.

DETAILED DESCRIPTION OF THE PREFERRED EMBODIMENTS

Embodiment 1

Hereinafter, a first embodiment of the present invention is explained with referring to FIGS. 1 to 4.

Figure 1:
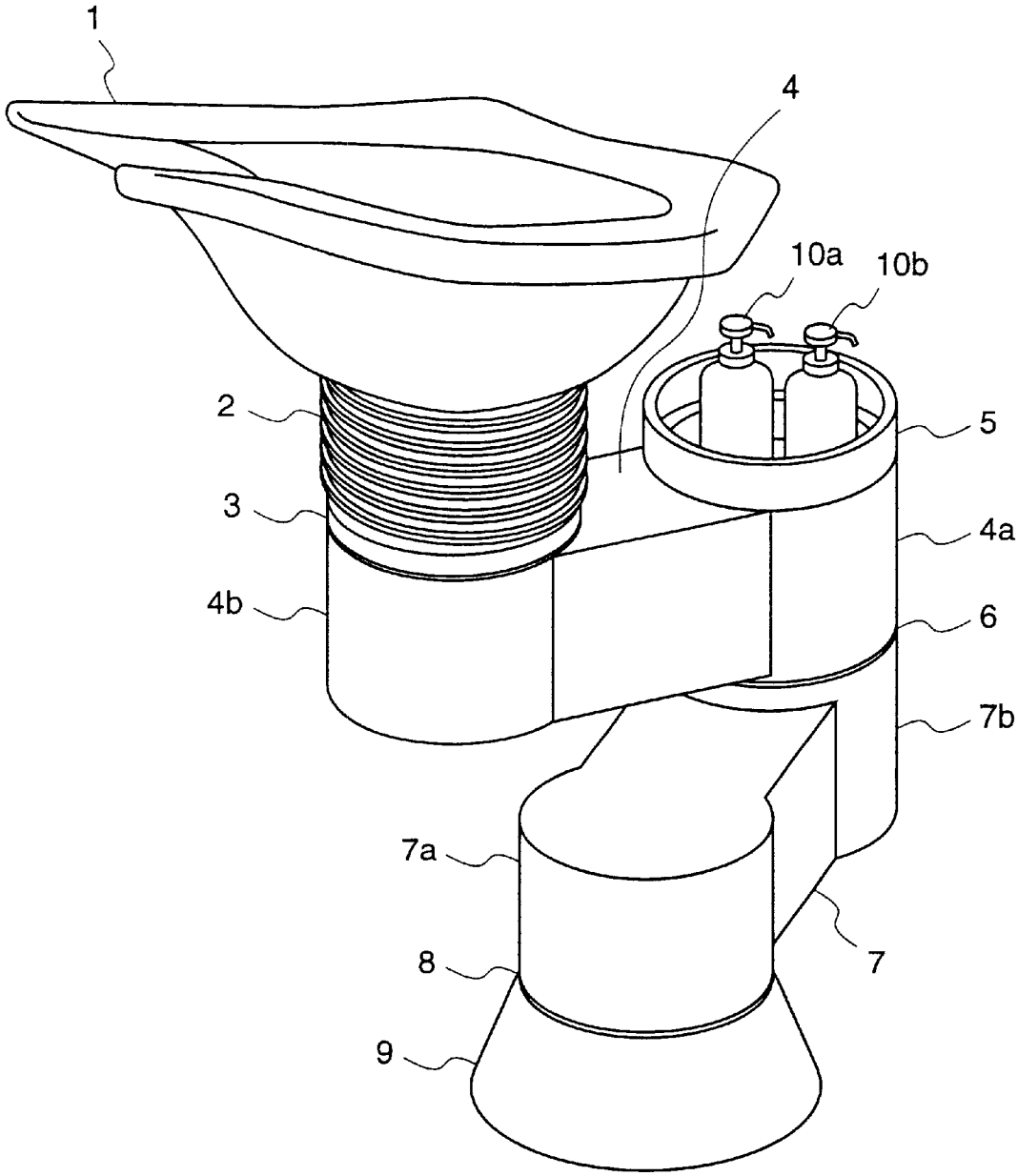
FIG. 1 is a perspective view illustrating a hair washing stand according to a first embodiment of the present invention.
Figure 2:
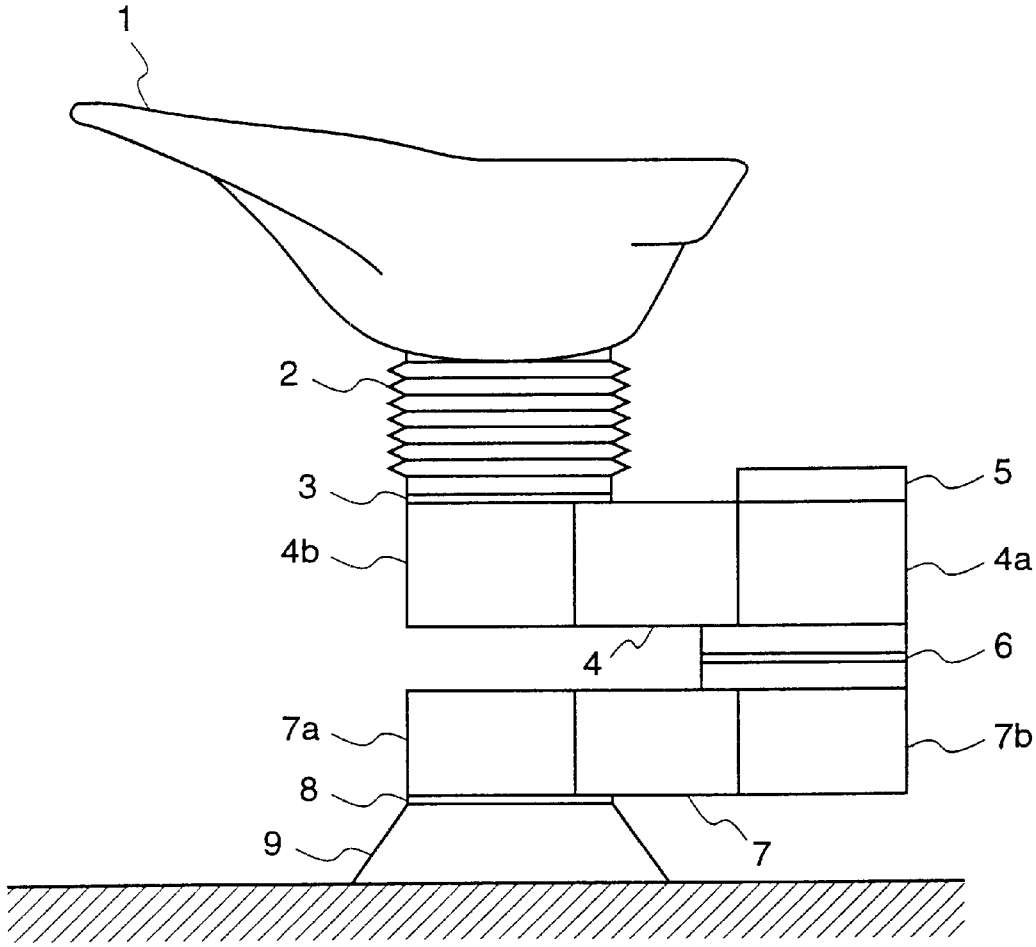
FIG. 2 is a side view illustrating a hair washing stand according to a first embodiment of the present invention.
Figure 3:
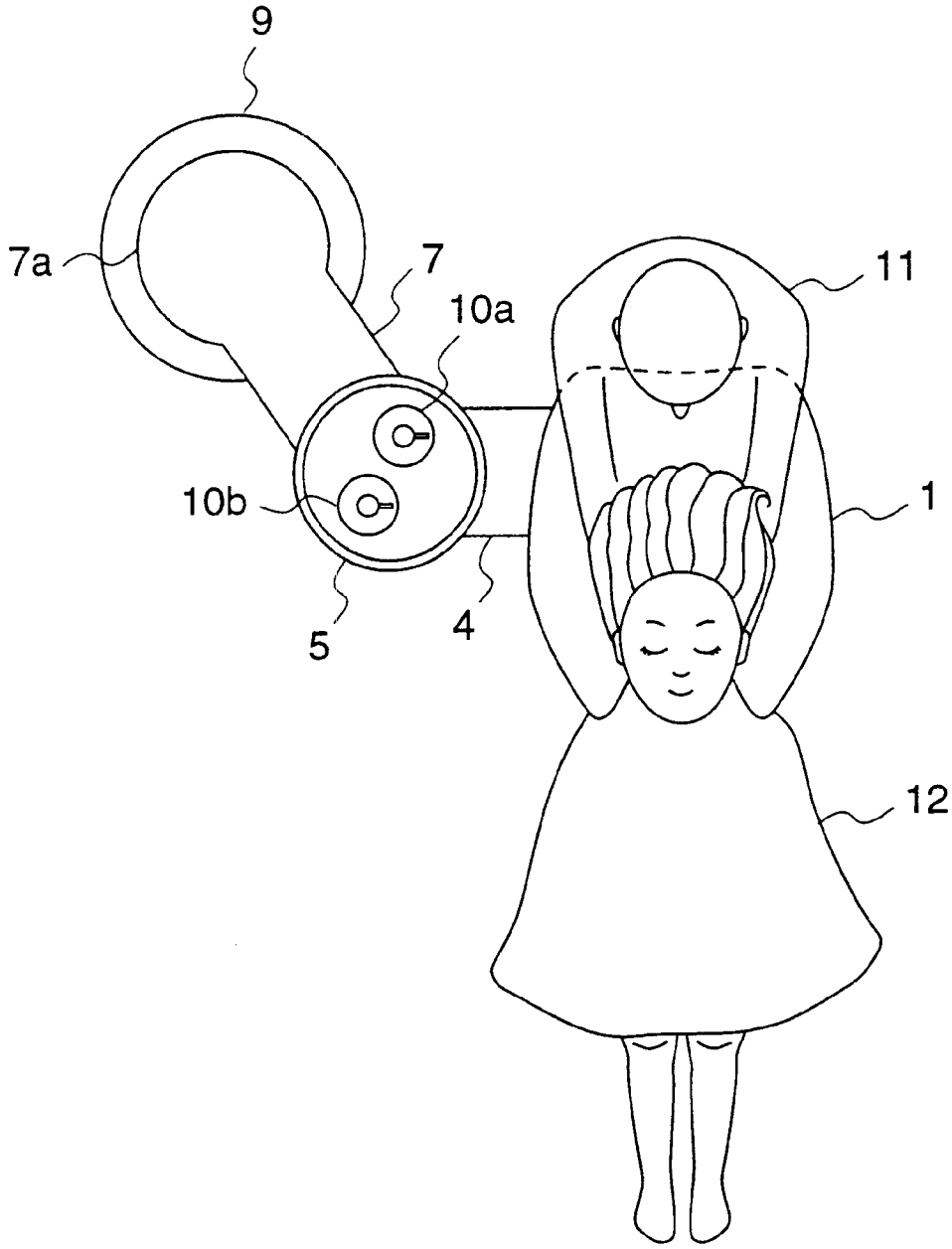
FIG. 3 is a view illustrating a usage state of a hair washing stand according to a first embodiment of the present invention.

In FIGS. 1 and 2, numeral 9 designates a pedestal part which is fixed on a floor surface. Numeral 7 designates a first arm, one end of which is a rotation shaft part 7*a* that is placed on the pedestal part 9 via a first bearing 8 and is rotatable with respect to the pedestal part 9. Numeral 4 designates a second arm, one end of which is a rotation shaft 4*a* that is placed on the rotation shaft part 7*b* via a second bearing 6. Numeral 4*b* designates a rotation shaft part located at the other end of the second arm 4. Numeral 1 designates a bowl, at which a shampooing process is performed. Numeral 2 designates an up and down mechanism, which is provided between the rotation shaft part 4*b* being the other end of the second arm 4 and the bowl via a third bearing 3, for moving the bowl up and down. Numeral 5 designates a tray placed on the rotation shaft part 4*a* located at one end of the second arm 4, on which shampoo agent 10*a* and rinse agent 10*b* are placed.

Next, an operation according to the first embodiment will be described.

Initially, the hair washing stand is in an inoperative state as illustrated in FIG. 2 in which the first arm 7 and the second arm 4 are overlapping each other, whereby the available space becomes restricted.

When an angle between the first arm 7 and the second arm 4 is widened from its inoperative state, a position of the bowl 1 is moved. Thereby, the hair washing stand can be placed in a position and a state where a hair washing of a head of a person to be shampooed can be easily performed at a bowl 1.

Next, the operator 11 makes a person to be shampooed 12 lay on his back on a chair in front of the bowl 1, and positions the head at a front part of the bowl 1. The height of the bowl is adjusted by the up and down mechanism 2, so that a position of the head of the person to be shampooed 12 is placed at an appropriate height.

Then, the operator 11 performs washing, shampooing, and rinsing, and takes out the required shampoo agent 10*a* and the rinse agent 10*b* from the placing position on the second arm 4, thereby performing a hair washing of the person to be shampooed. At this time, the shampoo agent 10*a* and the rise agent 10*b* are placed on the rotation shaft part 4*a* located at the other end of the second arm 4 and is placed at the hand of the operator. Therefore, the operator can easily take up or place the materials.

Further, when a placing position of the shampoo agent 10*a* and the rinse agent 10*b* is provided on the second arm 4, which is away from the bowl 1, the shampoo agent and the rinse agent do not become an obstacle to the works at hand. Therefore, the hair washing works can be better facilitated.

As shown in FIG. 1, when a tray 5 is employed, the shampoo agent 10*a* and the rinse agent 10*b* are kept in the tray, thereby preventing the hair washing agents and the hair washing tools from falling from the tray, on which they are placed, even when the arm part is operated.

Further, when the tray 5 is detachably placed, the shampoo agent 10*a* and the rinse agent 10*b* are in advance set in the tray, whereby they can be carried with the tray, and placed on the placing part. Therefore, a placement of the hair washing agents and the hair washing tools can be best facilitated. Further, even when other hair washing agents 10 are necessary to be prepared due to changes in an operator, a person to be shampooed, and hair washing materials, the hair washing materials can be changed on the tray 5. Therefore, such occasions can be appropriately managed, and a preparation of the hair washing agents 10 can be promptly and easily performed. Further, when the hair washing stand is cleaned, the tray 5 is detached from the rotation shaft 4*a* of the second arm 4.

Figure 4:
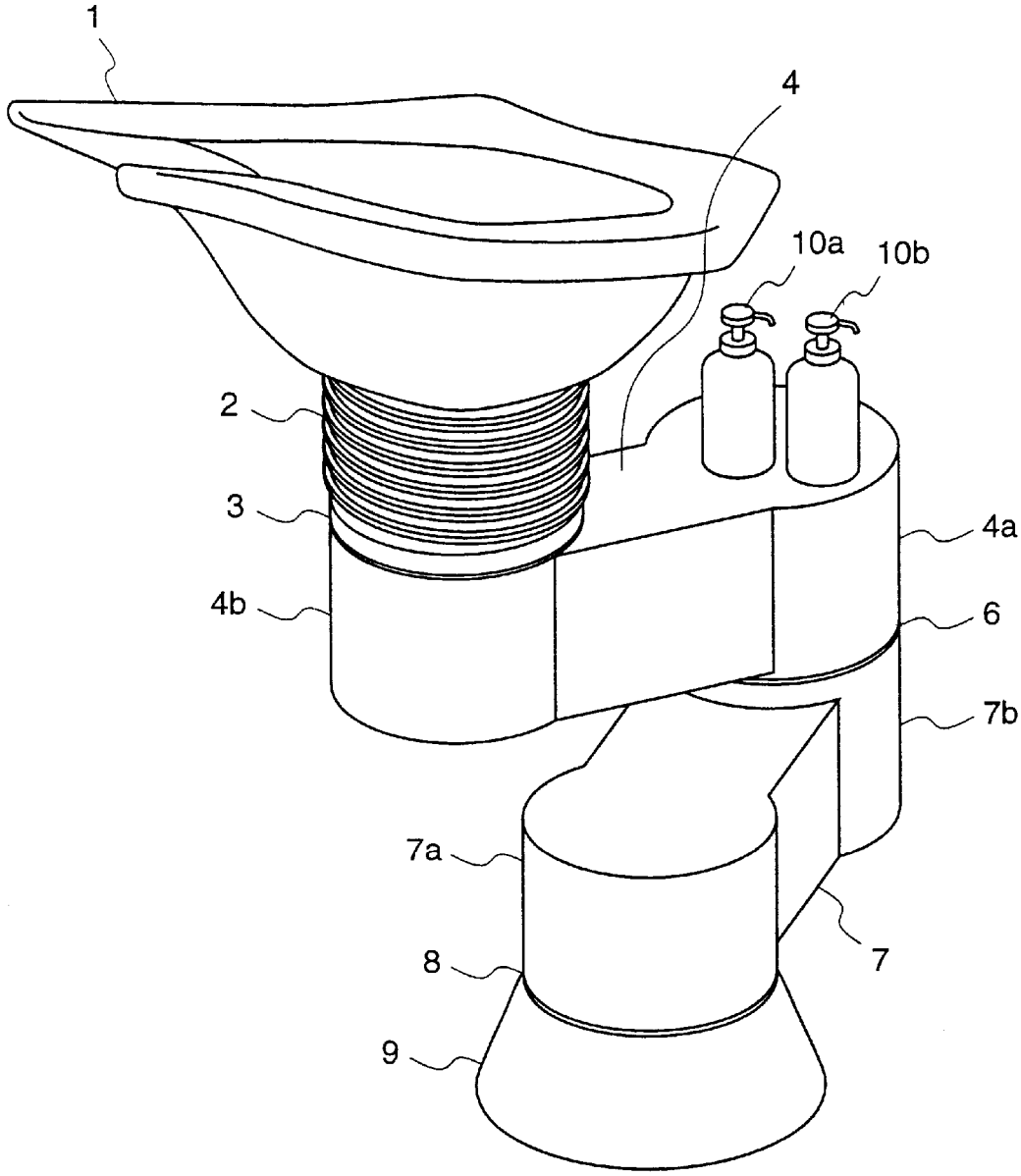
FIG. 4 is a perspective view illustrating a hair washing stand according to a first embodiment of the present invention.

FIG. 4 is a view illustrating the shampoo agent 10*a* and the rinse agent 10*b* being placed directly on the second arm 4. In this case, the operator can place the hair washing materials at a most suitable position for his works on the second arm 4. This can be similarly adopted when the hair washing materials are kept on a tray or the like, and placed on the second arm without being fixed.

When the hair washing stand is put away, the occupied space can be narrowed to a state shown in FIG. 2. At this time, the tray can be removed.

As described above, according to the hair washing stand of the first embodiment of the present invention, the operator places the hair washing agents and the hair washing tools, which are required for shampooing processes, on the second arm. Therefore, the hair washing materials can be always placed in his neighborhood where they do not impede his works at hand. Further, he can reach the hair washing agents and the hair washing tools without requiring going to the cabinet, thereby improving his or her efficiency of performance.

The hair washing materials are kept in the tray, whereby a preparation and an exchange of the hair washing agents and the hair washing tools can be performed with the tray, thereby simplifying the works. Further, when a recess part for keeping the tray is provided on the arm part, the hair washing materials can be prevented from falling therefrom when the arm part is moved in a circle. Further, when the tray is removed, a cleaning can be easily performed.

Hereinafter, a second embodiment of the present invention will be described with reference to FIG. 5.

Figure 5:
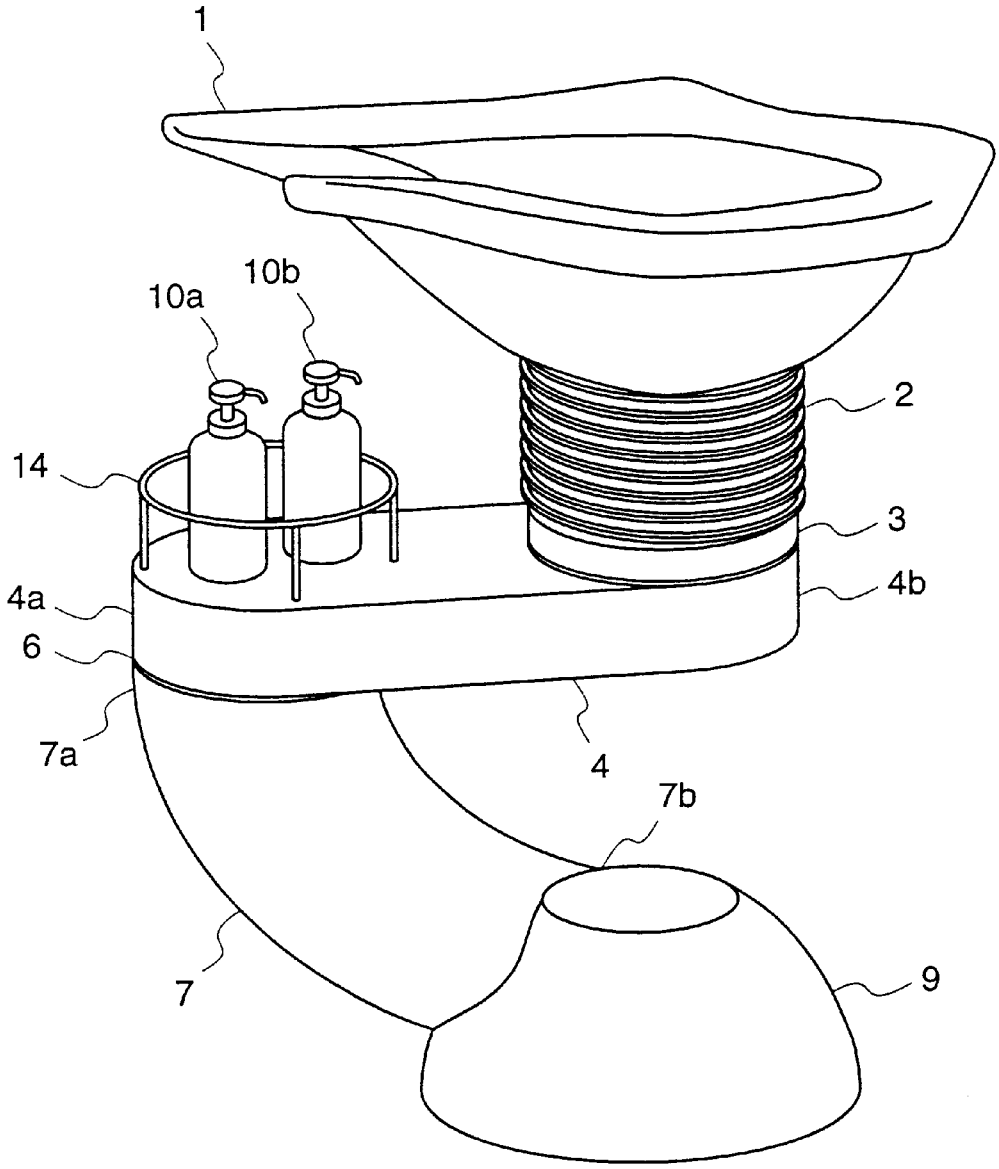
FIG. 5 is a perspective view illustrating a hair washing stand according to a second embodiment of the present invention.

In FIG. 5, numeral 9 designates a pedestal part placed on a floor surface. Numeral 7 designates a first arm, one end 7*b* of which is placed on the pedestal part 9. Numeral 4 designates a second arm, one end of which is a rotation shaft part 4*a* placed on the rotation shaft part 7*b* via a second bearing 6. Numeral 4*b* designates a rotation shaft part located at the other end of the second arm 4. Numeral 1 designates a bowl, at which the shampooing is performed. Numeral 2 designates an up and down mechanism, which is provided between the rotation shaft part 4*b* located at the other end of the second arm 4 and the bowl via a third bearing 3, for moving the bowl 1 up and down. In FIG. 5, numeral 13 designates a fence provided in a space over the second arm 4, in which shampoo agent 10*a* and rinse agent 10*b* are kept wherein the fence functions to prevent the articles from falling off the arm.

Next, operations in the second embodiment are performed similarly as in the first embodiment. More particularly, an angle between the first arm and the second arm is widened from an inoperative state to an operative state, thereby placing the hair washing stand and the bowl at a position where a hair washing of a person to be shampooed can be best facilitated. After the person to be shampooed lies on his back on a chair and places his head at the bowl, a height of the bowl is adjusted. Thereafter, the operator performs a shampoo to the person to be shampooed. At this time, the shampoo agent 10*a* and the rinse agent 10*b* are kept inside the fence 13 which is provided directly in the space over the second arm 4. Similarly and as in the first embodiment, the shampoo agent and the rinse agent are placed at the hand of the operator. Therefore, the operator can easily take up or place the same.

As described above, according to the hair washing stand of the second embodiment of the present invention, the shampoo agent and the rinse agent are kept inside of the fence for preventing them from falling provided in the space over the second arm, thereby preventing the materials from falling. Further, he can easily reach the shampoo agent and the hair washing tools during the performance of shampooing, whereby a more efficient performance can be best facilitated.

What is claimed is:

1. A hair washing stand that includes a pedestal for supporting the stand, said pedestal being affixed to a stationary substrate;

a first lower arm having opposed ends wherein one opposed end of said lower arm is rotatably mounted upon said pedestal for rotation in a full circle about a first vertical axis;

a second upper arm having a secured end and a free end, said secured end of the upper arm being rotatably affixed to a second opposite end of the lower arm so that the upper arm can swing in a full circle over the lower arm about a second vertical axis;

a bowl adjustably mounted upon the free end of the upper arm and means to vertically position the bowl to a desired height above the upper arm; and a tray for supporting loose hair washing materials, said tray being removably mounted upon the secured end of said upper arm directly over the second axis of rotation.

2. The hair washing stand of claim 1 wherein the tray is removably supported upon a rotating shaft.

3. The hair washing stand of claim 1 wherein the upper and lower arms are horizontally disposed.

4. The hair washing stand of claim 1 wherein said upper arm lies in a horizontal plane and the lower arm lies in a plane that forms an angle with said horizontal plane.

* * * * *